US008002127B2

(12) United States Patent
Ward et al.

(10) Patent No.: US 8,002,127 B2
(45) Date of Patent: Aug. 23, 2011

(54) VALET ROD AND SUPPORT

(75) Inventors: Kevin M. Ward, Louisville, KY (US); David P. Noe, Jeffersontown, KY (US)

(73) Assignee: Rev-A-Shelf Company, LLC, Jeffersontown, KY (US)

( * ) Notice: Subject to any disclaimer, the term of this patent is extended or adjusted under 35 U.S.C. 154(b) by 593 days.

(21) Appl. No.: 12/132,378

(22) Filed: Jun. 3, 2008

(65) Prior Publication Data

US 2009/0294389 A1 Dec. 3, 2009

(51) Int. Cl.
*A47H 1/08* (2006.01)

(52) U.S. Cl. ..... 211/105.3; 211/124

(58) Field of Classification Search ..... 211/105.3, 211/1.3, 86.01, 87.01, 171, 172, 85.3, 197, 211/104, 99–102, 204, 182, 206, 45, 124
See application file for complete search history.

(56) References Cited

U.S. PATENT DOCUMENTS

| | | | | | |
|---|---|---|---|---|---|
| 1,096,282 | A * | 5/1914 | Boehm | 248/251 |
| 3,249,233 | A * | 5/1966 | Marcus et al. | 211/105.3 |
| 3,335,872 | A * | 8/1967 | Dodich | 211/85.3 |
| 3,954,182 | A * | 5/1976 | McEvers | 211/94.01 |
| 4,144,972 | A | 3/1979 | Wiser | 211/113 |
| 4,209,099 | A * | 6/1980 | Wickes | 211/182 |
| 4,474,299 | A * | 10/1984 | Andrews | 211/193 |
| 4,561,549 | A * | 12/1985 | Yokohori | 211/182 |
| 4,585,127 | A * | 4/1986 | Benedict | 211/34 |
| 4,624,374 | A * | 11/1986 | Murtaugh | 211/60.1 |
| 4,771,899 | A * | 9/1988 | Benedict et al. | 211/60.1 |
| 5,617,962 | A * | 4/1997 | Chen | 211/206 |
| 5,690,236 | A | 11/1997 | Galilea | 211/104 |
| 5,743,412 | A * | 4/1998 | Noble | 211/59.2 |
| 6,131,749 | A * | 10/2000 | Crockett et al. | 211/195 |
| 6,390,311 | B1 * | 5/2002 | Belokin | 211/204 |
| 6,394,289 | B1 | 5/2002 | Panchihak et al. | 211/105.1 |
| 6,543,731 | B1 * | 4/2003 | Mercier | 248/62 |
| 6,719,156 | B2 * | 4/2004 | Ellbogen et al. | 211/105.1 |
| 6,796,446 | B2 * | 9/2004 | Segall et al. | 211/206 |
| 6,871,749 | B2 | 3/2005 | Bostick et al. | 211/94.01 |
| 6,976,595 | B1 * | 12/2005 | Geller | 211/94.01 |
| 7,121,418 | B2 * | 10/2006 | Stier | 211/206 |
| 7,249,679 | B2 * | 7/2007 | Klein | 211/37 |
| 7,490,424 | B2 * | 2/2009 | Caterinacci | 40/606.14 |
| 7,604,131 | B1 * | 10/2009 | Clark et al. | 211/17 |
| 2002/0153337 | A1 * | 10/2002 | Shuen | 211/123 |
| 2003/0071001 | A1 * | 4/2003 | Goldberg | 211/123 |
| 2007/0163974 | A1 * | 7/2007 | Lai | 211/85.3 |
| 2008/0029473 | A1 * | 2/2008 | Hu | 211/206 |

* cited by examiner

*Primary Examiner* — Jennifer E. Novosad
(74) *Attorney, Agent, or Firm* — Brinks Hofer Gilson & Lione

(57) ABSTRACT

A valet rod slide mounting assembly is provided for mounting to a supporting surface, such as a door, closet organizer, wall, or the like. The assembly includes a rod and a tube receiving the rod for sliding movement between an extended position and a retracted position when the tube overlaps substantially the rod. The assembly also includes at least two anchors for mounting the tube to the supporting surface. The anchors include a first bore sized to receive the tube and a second bore perpendicular to the first bore and sized to receive a mounting element that engages the support surface. The anchors can also include a third bore where a tube retainer is positioned to engage the tube securably. The assembly can also include a plurality of hooks that depend from the rod, with respective components including slots to permit the hooks to engage the rod continuously while sliding.

15 Claims, 8 Drawing Sheets

VALET ROD AND SUPPORT

BACKGROUND OF THE INVENTION

1. Field of the Invention

The present invention is directed to a hanger assembly, with, specifically, a valet rod slide mounting assembly with an outer tube and anchors for mounting the tube to a supporting surface. In particular, the present invention relates to valet rod slide mounting assembly that provides temporary storage and organization for hanging clothes or personal effects or accessories, such as neckties and belts or the like.

2. Description of the Prior Art

Valet rods are well known for home, hotel and other commercial use. Valet rods are adapted primarily to provide temporary storage for hanging clothes or other objects for easy access while the items are waiting to be sorted, distributed or worn. Most commonly, the valet rods are attached to a supporting surface, such as a door, a surface of a storage compartment or closet organizer system, or even a wall. In this scenario, the valet rods extend horizontally and parallel with the floor; and the items hanging or suspended from the valet rods extend vertically and perpendicular with the floor.

There are presently available a number of different configurations and assemblies of valet rods. For example, U.S. Pat. No. 6,394,289 to Panchihak, discloses a rotating valet rod, or hanging arm, that attaches to a vertically extending supporting surface, usually perpendicular to a wall, and rotates or pivots about one end of the valet rod. Only one end of the valet rod is attached to the supporting surface by a base plate. The base plate consists of several components which can make assembly difficult and time consuming. The base plate includes two stops that represent physical stops to the rotating valet rod, with one stop representing the extending operative position and the second stop representing the retracted position. In the extending operative position, the valet rod extends parallel to the supporting surface and perpendicular to the wall. The total extension of the valet rod is fixed without a telescoping feature, and the capacity of the valet rod is limited due to length and material of the valet rod. There can be a reduced portion provided on the free end of the valet rod to preclude articles carried by the rod from sliding off the free end.

Other valet rods can include a telescoping feature. For example, U.S. Pat. No. 6,871,749 to Bostick, discloses an extendable valet rack assembly including a three-piece slide assembly and a heavy duty two-piece slide assembly. The slide assemblies are similar to a drawer-type sliding assembly. For example, both slide assemblies have a base rail for installation on a supporting surface. The three-piece slide assembly an intermediate extension member slidably coupled to the base rail and an outer housing member slidably coupled to the intermediate extension member. The two-piece slide assembly has only an outer housing member slidably coupled to the base rail. Slidably coupled to the outer housing member is an apparel support member in the form of a tie clasp or belt post. With the alignment of all of the sliding members and number of components, the slide assembly can be difficult and time consuming to assemble.

Accordingly, there remains a need for a telescoping valet rod and support that consists of an optimal number of components for easier assembly and installation. It is desirable that these features be incorporated in an assembly that when installed and fully extended can handle an optimal number of hanging clothes, personal effects or both. It is also desirable that a valet rod and support be adapted to provide storage for hanging clothes or other objects for easy access when the valet rod is at the fully extended, at the fully retracted position, or in between without having to remove the items.

SUMMARY OF THE INVENTION

A valet rod slide mounting assembly is provided for easier assembly and installation when mounting to a supporting surface. The assembly includes a rod and a tube receiving the rod for sliding movement relative to the tube. The rod can slide or telescope between an extended position when the rod is almost completely out of the tube and a retracted position when the tube overlaps substantially the entire rod. Preferably, the rod and the tube have circular cross-sections, and have a handle attached to one end of the rod. At least two anchors for mounting the tube to the supporting surface are also included with the assembly. The anchors include a first bore sized to receive the tube, and a second bore perpendicular to the first bore and sized to receive a mounting element that engages the support surface. Preferably, each anchor comprises a cylindrical body having a mounting surface and an obverse surface each parallel to the supporting surface when mounted to the supporting surface. In addition, the mounting element preferably does not interfere with the received tube. Each anchor can also include a third bore where a tube retainer screw positioned to engage the tube securably to a substantially fixed location.

In another embodiment of a valet rod slide mounting assembly, in addition to the rod, tube, and anchors described above, the assembly can further include a plurality of hooks that depend from the rod. In this embodiment, the rod includes a slot where the hooks depend from. The tube also includes a slot and the anchors include a channel aligned with the tube slot. A bushing member securably engaged within the tube lumen and sized to receive the sliding rod can also be provided with the assembly, and can also include a slot. The addition of the slots and channels with the respective components permits the hooks to engage the rod continuously while sliding between the extended position and the retracted position. The rod can further include a means for retaining the rod to prevent the rod from sliding completely out of the bushing member.

In one aspect, the present invention of the valet rod slide mounting assembly including the plurality of hooks can also include differing configurations of hooks. Here, at least one first hook of the plurality of hooks can include: a first portion attached to the rod extending angularly downward and away from the rod; a bearing portion attached to the first portion extending horizontally and perpendicular to the supporting surface when attached; and a second portion attached to the bearing portion extending angularly upward and away from the rod. In addition, at least one second hook of the plurality of hooks can include: a first portion attached to the rod extending angularly downward and away from the rod; a bearing portion attached to the second hook first portion extending horizontally and perpendicular to the supporting surface when attached; and a second portion attached to the second hook bearing portion extending angularly upward and away from the rod. At least one difference between the first and second hooks is that the first portion of the second hook extends further down than the first portion of the first hook.

One feature of the valet rod slide mounting assembly is that the assembly can consist of an optimal number of components for easier assembly and installation. In one example, for illustrative purposes only, the number of components for assembly and installation could be nine: one rod, one tube, one handle, two anchors, two tube retainers, and two mounting elements. Furthermore, the design of the anchor assists in optimizing the number of components for easier assembly and installation. Desirably, these features mentioned above are incorporated in an assembly that, when installed and the rod is fully extended, can handle an optimal number of hanging clothes, personal effects or both. Another feature is that the valet rod slide mounting assembly is adapted to provide storage for hanging clothes or other objects for easy access when the valet rod is at the fully extended, at the fully retracted position, or in between without having to remove the items. That is when the valet rod slide mounting assembly includes a plurality of hooks, the hooks can be unaffected by the position of the valet rod. Lastly, another feature is that the valet rod slide mounting assembly is made of materials that can be provided with a finish that evokes chrome, satin nickel, oil rubbed bronze, or other finishes that are aesthetically pleasing and decorative.

Other features and advantages of the present invention will become apparent to those skilled in the art from the following disclosure of preferred embodiments of the present invention exemplifying the best mode of practicing the invention. The following disclosure references the accompanying drawings illustrating the preferred embodiments.

DESCRIPTION OF PREFERRED EMBODIMENTS

Figure 1:
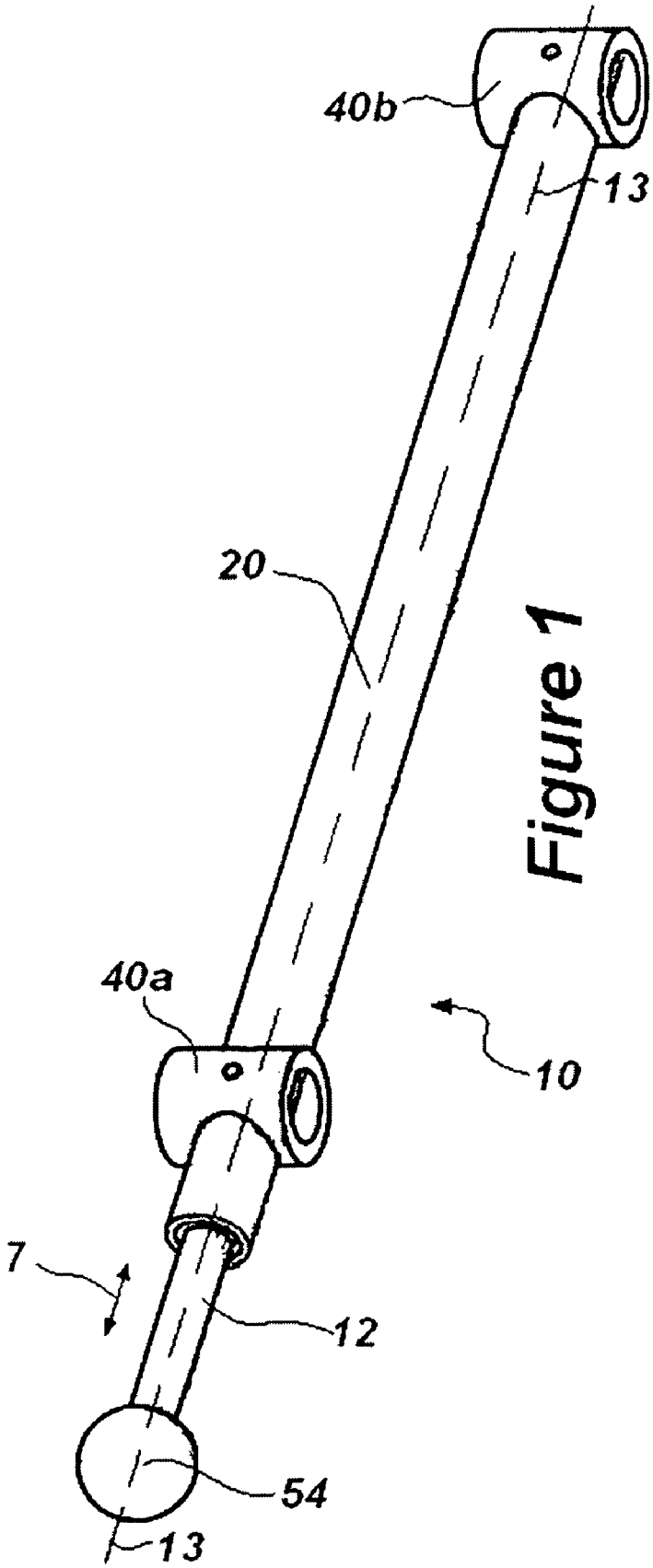
FIG. 1 is a perspective view of one embodiment of a valet rod slide mounting assembly.

Referring to the drawings, where like reference numerals are used throughout the various views to designate like components, and more particularly to FIG. 1 thereof, which illustrates one embodiment of the valet rod slide mounting assembly 10. Preferably, the valet rod slide mounting assembly 10 is installed and mounted to a supporting surface 8 (represented in FIG. 3). The supporting surface 8 can be one side of an entry door or closet door, a side wall or partition of an armoire, storage compartment, or closet organizer system, or a wall of a room or closet. The valet rod slide mounting assembly 10 can be adapted primarily to provide temporary storage for hanging clothes or personal effects, such as neckties and belts or the like for easy access while the items are waiting to be sorted, distributed, or worn.

According to FIG. 1, the valet rod slide mounting assembly 10 can include a rod 12, a tube 20 receiving the rod 12 for sliding or telescoping movement relative to the tube 20, at least two anchors 40 (40*a*, 40*b*) for mounting the tube 20, and may also include a handle 54. FIG. 1 illustrates the tube 20 receiving the rod 12 for sliding movement, represented by arrows 7, along a longitudinal axis 13. The sliding movement of the rod 12 is defined between an extended position when the rod 12 is almost completely out of the tube 20 and a retracted position when the tube 20 overlaps substantially the entire rod 12.

Figure 2:
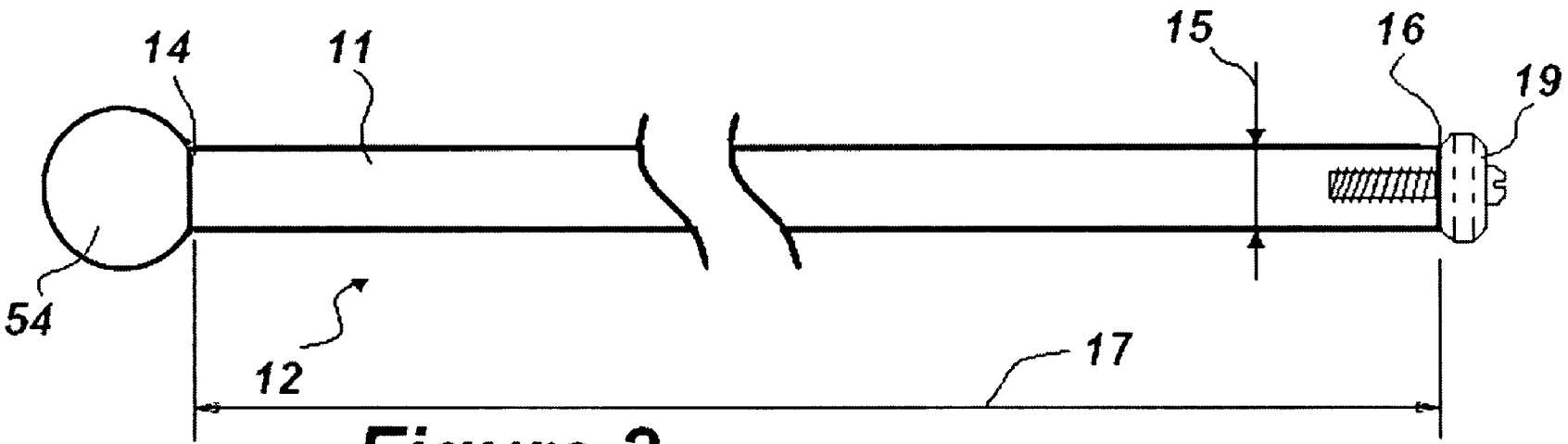
FIG. 2 is a side view of a rod.

As illustrated in FIG. 2, the rod 12 can include a body 11 having a first end 14 and second end 16 and a length 17 between the first and second ends 14, 16. Preferably, the body 11 of the rod 12 is a tubular structure having a circular cross-sectional area with a diameter 15 on the exterior and defining a lumen between the first and second ends 14, 16. Alternatively, the rod body 11 can be a solid tubular structure having the diameter 15, or the cross-sectional area of the rod body 11 can be a shell or a solid that has an elliptical, rectangular, or other shape known in the art. In order to prevent the rod 12 from sliding completely out of the tube 20, the rod 12 can include a means 19 for retaining at one end of the first and second ends 14, 16 of the rod 12, described in further detail below.

Figure 3:
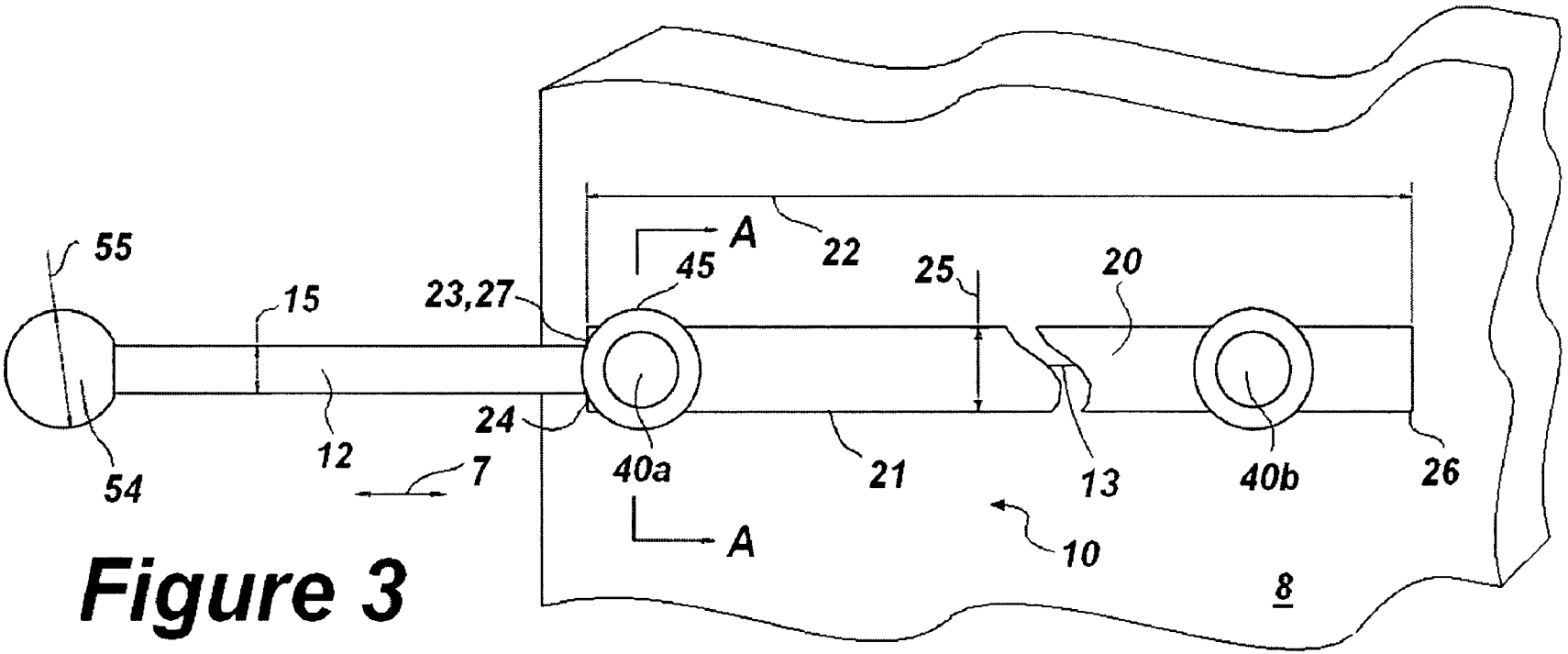
FIG. 3 is a side view of a valet rod slide mounting assembly mounted on a supporting surface.

In FIG. 3, the valet rod slide mounting assembly 10 is shown to be attached to the supporting surface 8. The tube 20 of the valet rod slide mounting assembly 10 is sized to permit sliding movement of the rod 12 relative to the tube 20. The tube 20 can include a body 21 having a first end 24 and a second end 26 and a length 22 between the first and second ends 24, 26. Preferably, the body 21 of the tube 20 is a tubular structure having a circular cross-sectional area with a diameter 25 of the exterior defining a lumen 23 having a diameter 27. Alternatively, the cross-sectional area of the tube body 21 can be elliptical, rectangular, or other shape known in the art, nevertheless the cross-sectional area of the tube body 21 and rod body 11 should be similarly shaped. The rod 12 and the tube 20 can provide hanging support for clothes, personal effects, or both. Preferably, there are no bores running through the wall of the tube 20. The rod 12 and the tube 20 can be formed and machined of metal, preferably stainless steel, brass, galvanized or chromed steel; plastics, such as ABS, polycarbonate, polypropylene, or other high impact resistance engineered plastics; extruded aluminum preferably having an anodized finish, or other metals and materials commonly known in the art. Preferably, the finish of the material evokes chrome, satin nickel, oil rubbed bronze, or other finishes that are aesthetically pleasing and decorative.

Figure 4A:
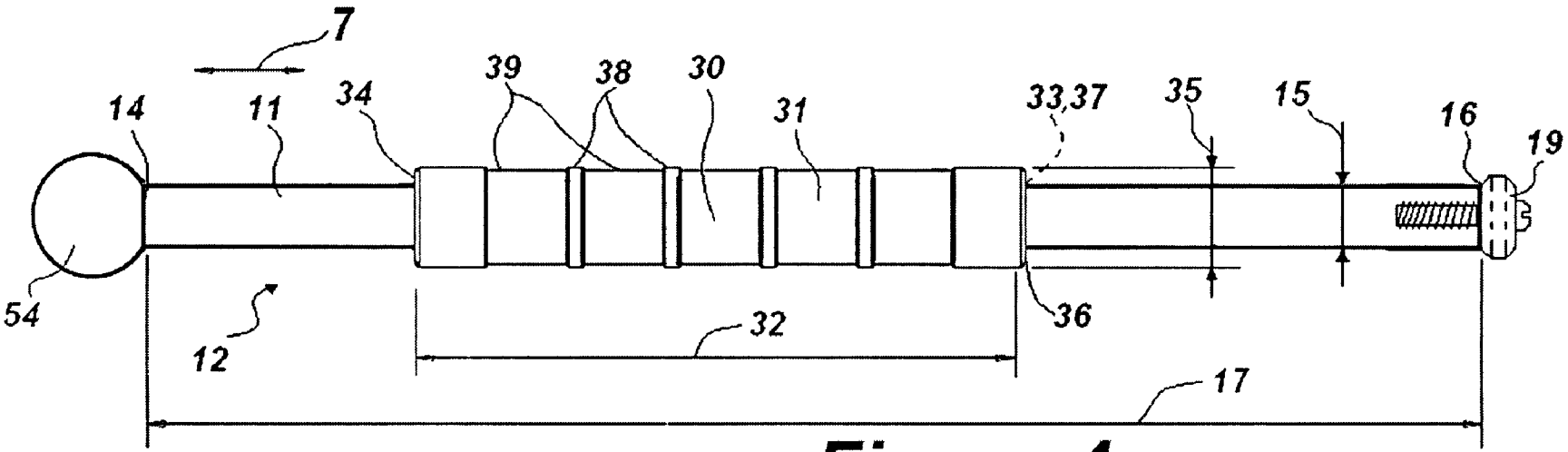
FIG. 4*a* is a side view of a rod and a bushing member of the valet rod slide mounting assembly.

Referring to FIG. 4*a*, a bushing member 30 can also be provided with the valet rod slide mounting assembly 10 to ease in, and support, the sliding or telescoping movement of the rod 12. The bushing member 30 is sized and configured to press fit within the tube lumen 23 to prevent longitudinal movement of the bushing member 30. Another function of the bushing member 30 is the ability to support a fully extended rod 12 when loaded with hanging clothes, personal effects, or the like, or event a larger load, e.g., an overnight garment bag. The bushing member 30 can include a body 31 having a first end 34 and a second end 36 and a length 32 defined as the distance between the first and second ends 34, 36. The bushing member body 31 is preferably a tubular structure having a circular cross-sectional area with a diameter 35 of the exterior. The cross-sectional area with the diameter 35 of the bushing member 30 is sized to be less than the cross-sectional area with the tube lumen diameter 27 to substantially prevent longitudinal movement of the bushing member 30 within, and to engage securably with the tube lumen 23. The bushing member body 31 also defines a lumen 33 having a circular cross-sectional area with diameter 37 between the first and second ends 34, 36. The cross-sectional area with the lumen diameter 37 of the bushing member 30 can be sized to be greater than the cross-sectional with rod diameter 15 to permit sliding movement of the rod 12 relative to the bushing member 30.

Figure 4B:
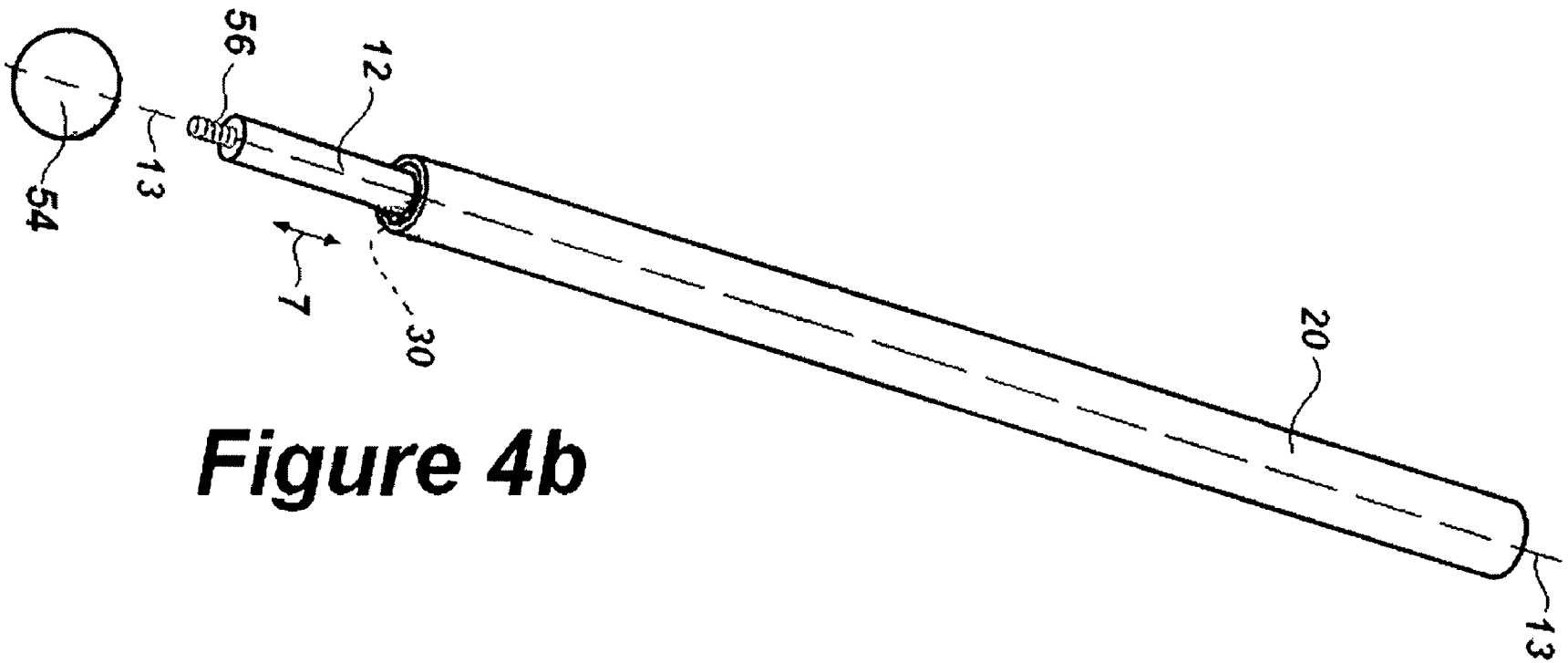
FIG. 4*b* is a perspective view of a sliding rod, a bushing member, and a tube of the valet rod slide mounting assembly.

FIG. 4*b* illustrates the tube 20 receiving the rod 12 for sliding movement, represented by arrows 7, along a longitudinal axis 13. In order to prevent the rod 12 from sliding completely out of the bushing member 30, the rod 12 can further include the means 19 for retaining, as described above, at one end of the first and second ends 14, 16 of the rod 12. The means 19 for retaining has a cross-sectional area greater than the cross-sectional area of the bushing member lumen diameter 37, but less than the cross-sectional area of the tube lumen diameter 27. The cross-sectional area of the means 19 for retaining is suitably small enough to permit the rod 12 to slide, yet, large enough to prevent the rod 12 from sliding out of the bushing member 30. The means 19 for retaining can include a washer attached to the end of the rod 12. The washer is preferably made of plastic, but can be made of rubber, metal, or the like. The means 19 for retaining can also include a pin inserted through an opening transversing the end of the rod 12, an expandable sleeve or ring inserted around a groove at the end of the rod 12, or a second bushing enclosing and attached to the end of the rod 12. The bushing member 30 can be formed of processes and materials similar to that of the rod 12 and the tube 20. The bushing member 30 is preferably made of polyoxymethylene (POM), such as DELRIN, a registered trademark of DuPont de Nemours, Wilmington, Del., which offers low friction and wear resistance.

One embodiment of the bushing member 30 is illustrated in FIG. 4*a* depicting a series of raised portions 38 having a cross-sectional area being sized to be less than the cross-sectional area of tube lumen diameter 27. The raised portions 38 can have different lateral widths. For example, the raised portions 38 on the ends 34, 36 of the bushing member 30 can have a wider lateral width than the raised portions 38 between the ends 34, 36 of the bushing member 30, which are narrower. Connecting the raised portions 38 are a series of webs 39 having a cross-sectional area less than the cross-sectional area of the raised portions 38. The webs 39 are machined or manufactured into the bushing member body 31. This arrangement of raised portions 38 and webs 39 allow the bushing member 30 to be press-fitted within lumen 23 of the tube 20 more easily by displacing a portion of the radially compressed raised portions 38 in a longitudinal direction. The suitable number and sizes of the raised portions 38 and webs 39 can be determined by one of ordinary skill in the art.

According to FIGS. 1-4*a*, at the other end of the first and second ends 14, 16 of the rod 12, generally opposite the position of the means 19 for retaining is the handle 54. The handle 54 can be used for initiating the sliding movement between the extended position and the retracted position and for precluding articles carried by the valet rod slide mounting assembly 10 from sliding off. The handle 54 can be any shape or size to match any decorative motif. The handle 54 is removably attached to the other end of the rod 12 by a common #8-32 threaded fastener 56, but a bolt, dowel, pin or other fasteners can be used. The removability of the handle 54 permits the handle 54 to be changed out with other decorative knobs or pulls out on the market. When the handle 54 is a spherical member, as shown in FIG. 4*a*, the handle 64 can have a diameter 55 greater than the cross-sectional area of the rod 12 and the tube 20. The handle 54 is preferably formed of processes and materials similar to that of the rod 12 and the tube 20 in order to evoke a uniform decorative look among the components.

Figure 5A:
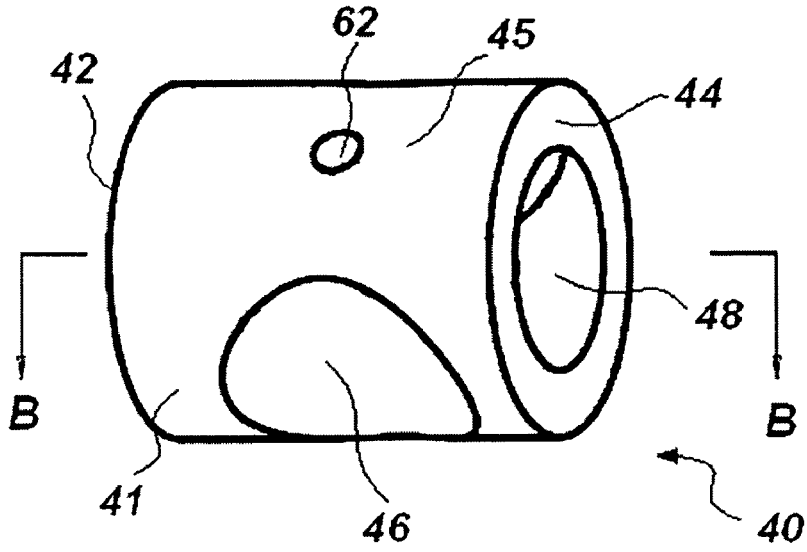
FIG. 5*a* is a perspective view of an anchor of the valet rod slide mounting assembly.
Figure 5B:
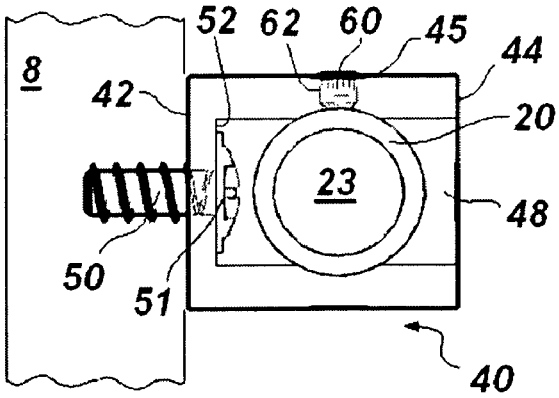
FIG. 5*b* is a cross-sectional view along line A-A of an anchor of the valet rod slide mounting assembly of FIG. 3.
Figure 5C:
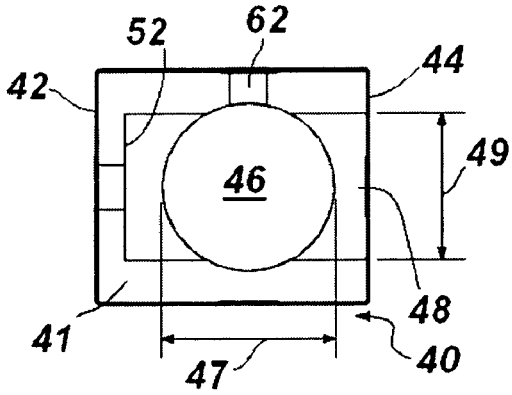
FIG. 5*c* is a cross-sectional view along line B-B of the anchor of FIG. 5*a*.

FIG. 5*a* and FIG. 5*c*, which is a cross-sectional view along line B-B in FIG. 5*a*, illustrate a preferred embodiment of the anchors 40. The anchors 40 of the valet rod slide mounting assembly 10 are provided to receive and align the tube 20 in an operative position and to mount the tube 20 to the supporting surface 8. Each anchor 40 can include a body 41 having a mounting surface 42 for engaging the supporting surface 8 and an obverse surface 44 facing opposite the supporting surface 8 when mounted to the supporting surface 8. The mounting and obverse surfaces 42, 44 preferably are positioned parallel the supporting surface 8 when mounted to the supporting surface 8. The anchor body 41 can be cylindrical, elliptical, cubical, or the like. A first bore 46, having a circular cross-sectional area with a diameter 47, can be provided within each anchor 40. The first bore cross-sectional area with the diameter 47 can be sized to receive the tube 20 with the cross-sectional area or the diameter 25. The anchors 40 are preferably coupled to the tube 20 proximate the first and second ends 24, 26 of the tube 20. A second bore 48, having a circular cross-section with a diameter 49 and situated substantially perpendicular to the first bore 46, can also be provided within each anchor 40. The second bore cross-sectional area with the diameter 49 can be less than the first bore cross-sectional area with the diameter 47.

FIG. 5*b* is a cross-sectional view along line A-A in FIG. 3 illustrating a mounting element 50 and a tube retainer 60 securably engaging the tube 20. The second bore cross-sectional area can be sized to receive the mounting element 50 for mounting each anchor 40 to the support surface 8. The mounting element 50 is preferably a wood screw, but can be a bolt, dowel, pin or other fastener known in the art. The second bore 48 can also include a shoulder 52, where the second bore cross-sectional area decreases to a size to securably receive the shank of the mounting element 50. The second bore shoulder 52 can be located proximate the mounting surface 42 of the anchor body 41 and used for engaging a head 51 of the mounting element 50. Preferably, when the mounting element 50 attaches each anchor 40 to the supporting surface 8, the mounting element head 51 does not interfere with the tube 20. Optionally, the thickness of the mounting element head 51 and thickness of the shoulder 52, generally defined by the wall thickness between the mounting surface 42 of the anchor body 41 and the bottom of the second bore 48, can be designed not to extend within the first bore 46.

Each anchor 40 can include the tube retainer 60 for coupling the tube 20 at a selected position within the first bore 46. Preferably, the tube retainer 60 is a screw configured to be fastened with an Allen wrench and to engage securely the outside of the tube 20. However, other fasteners can also be used, such as wood screws, metal screws, spring-loaded pins, or the like. The tube retainer 60 can contact the tube 20 through a third bore 62 that is perpendicular to the second bore 48 and the tube 20, as shown in more detail in FIG. 5*c*, illustrating the anchor 40 without the mounting element 50 and the tube retainer 60. The third bore 62 is sized to receive the tube retainer 60. The third bore 62 and the tube retainer 60 can be positioned anywhere on the anchor body 41. Preferably, the third bore 62 and the tube retainer 60 are positioned perpendicular to the longitudinal axis 13. Most preferably, the third bore 62 and the tube retainer 60 are positioned perpendicular to the longitudinal axis 13 at an upper surface 45 of the anchor 40 when mounted to the supporting surface 8.

Figure 6A:
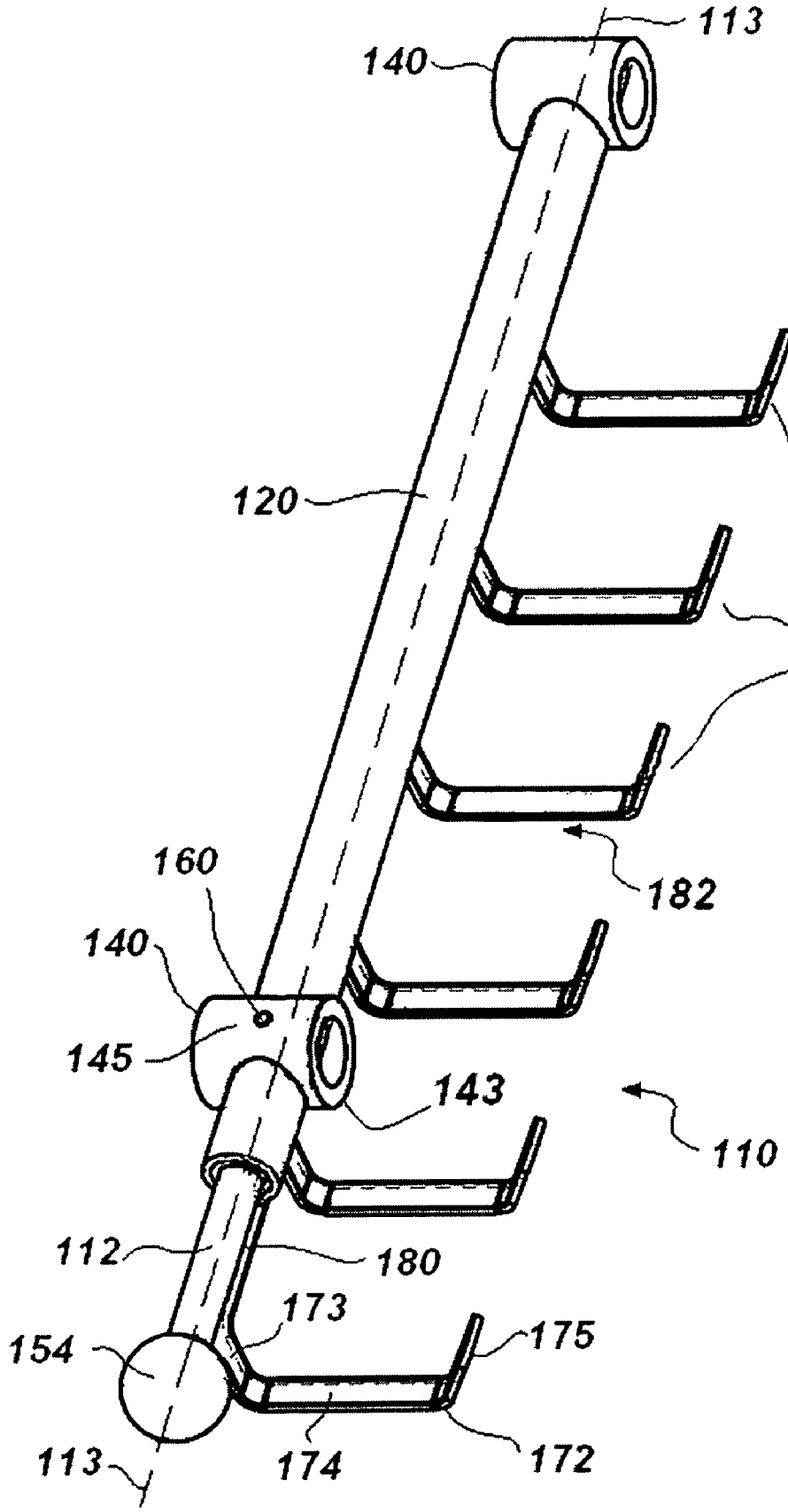
FIG. 6*a* is a perspective view of one embodiment of a valet rod slide mounting assembly including a plurality of hooks.
Figure 6B:
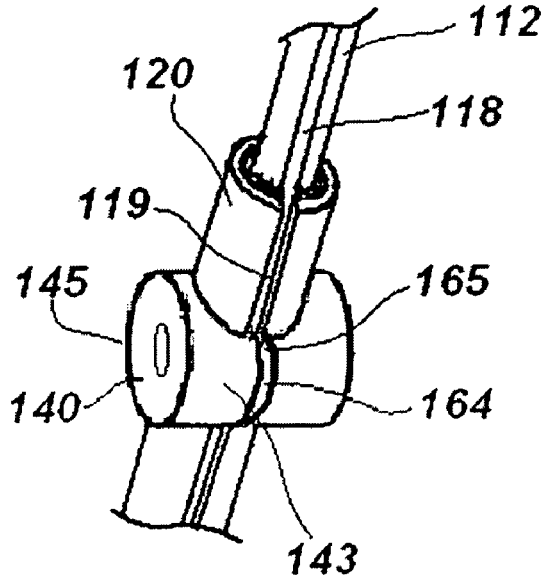
FIG. 6*b* is a perspective view of an underside of the valet rod slide mounting assembly of FIG. 6*a* without the plurality of hooks.

Another embodiment of the valet rod slide mounting assembly 110 along a longitudinal axis 113 can include a plurality of hooks 170 and the handle 154 as illustrated in FIG. 6*a*. The hooks 170 can provide hanging support for clothes, personal effects, or both For example, the hooks 170 can be configured to support neckties and belts (not shown), or even configured to support hanging a larger load, e.g., an overnight garment bag. The valet rod slide mounting assembly 110 contains all the limitations described above except with the following. The rod 112 can include a slot 118 extending longitudinally along the exterior surface of the rod 112, as shown in FIG. 6*b*. The rod slot 118 can provide an area of attachment for the hooks 170. In one embodiment, the hooks 170 removably attach to the rod 112 individually, and are independently moveable in relation to one another. Here, the hooks 170 can be arranged or spaced in any order. Yet, in another embodiment, the hooks 170 are uniformly attached to a supporting member 180, by which the combination defines a unitary hook attachment 182.

The unitary hook attachment 182 include the hooks 170 that are fixed at a position and not independently moveable. The unitary hook attachment 182 can be prefabricated as a single unit with a thickness to press fit within and securably engage the rod slot 118, yet at the same time be detachable from the rod slot 118. The length of the unitary hook attachment 182 can be about the same as the length of the rod 112. The hooks 170 can be equally spaced along the unitary hook attachment 182 by about a distance, L/(n−1) where, L is the length of the unitary hook attachment 182 and n is the number of hooks 170. For example, in FIG. 6*a* the spacing between the six hooks spaced along the length L of the length of the rod 112 that is about 7.0 inches (178 mm) is about 1.4 inches (35.6 mm). Optionally, the hooks 170 can be arranged or spaced in any order when the unitary hook attachment 182 is fabricated.

Referring to FIG. 6*b*, the tube 120 can also include a slot 119, as well as each anchor 40 can include a channel 164. The channel 164 is preferably defined by positioning the first bore 146 to intersect with a lower surface 143 of the anchor 140. Preferably, the anchor lower surface 143 is positioned opposite the anchor upper surface 145, where the tube retainer 160 is preferably positioned. More preferably, the rod slot 118, the tube slot 119, and the anchor channel 164 are positioned parallel to the longitudinal axis 113 and parallel to the supporting surface when mounted to the supporting surface. Most preferably, the rod slot 118, the tube slot 119, and the anchor channel 164 are positioned parallel to the longitudinal axis 113, parallel to the supporting surface when mounted to the supporting surface, and diametrically opposite from the tube retainer 160. The tube slot 119 and the anchor channel 164 define a pathway 165, through which the hooks 170 are disposed. The hooks 170 preferably depend from the rod 112, through the tube slot 119 and the anchor channel 164, when the rod 112 is moving between the extended position and the retracted position. This is beneficial in avoiding the hassle of removing the hooks 170, and hanging articles, when sliding the rod 112.

The hooks 170 can be formed in a variety of shapes and sizes. One embodiment of the hooks 170 includes at least one first hook 172, as illustrated in FIG. 6*a*. The first hook 172 can include a first portion 173 removably or fixedly attached to the rod 112 extending angularly downward and away from the rod 112. The first hook 172 can also include a bearing portion 174 attached to the first hook first portion 173 extending horizontally and perpendicular to the supporting surface when mounted to the supporting surface. The first hook 172 can also include a second portion 175 attached to the first hook bearing portion 174 extending angularly upward and away from the rod 112.

Figure 6C:
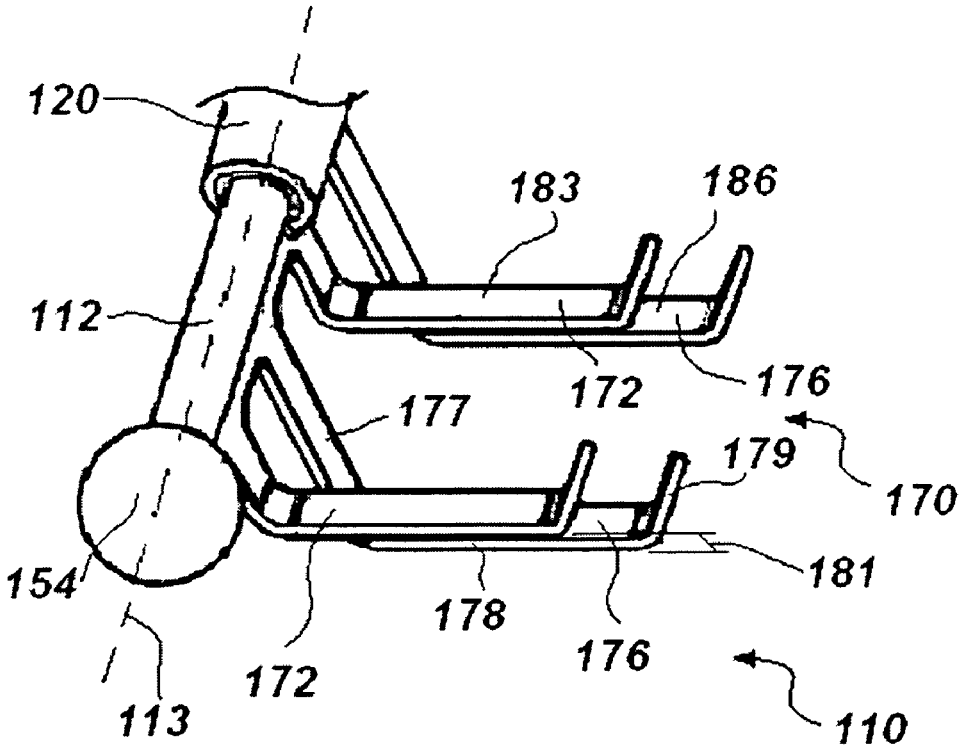
FIG. 6*c* is a perspective view of one embodiment of a valet rod slide assembly including a plurality of first and second hooks.

As illustrated in FIG. 6*c*, another embodiment of the hooks 170 includes at least one first hook 172, as described above, and at least one second hook 176. The second hook 176 can also include a first portion 177 removably or fixedly attached to the rod 112 extending angularly downward and away from the rod 112. The second hook 176 can also include a bearing portion 178 attached to the second hook first portion 177 extending horizontally and perpendicular to the supporting surface when mounted to the supporting surface. The second hook 176 can also include a second portion 179 attached to the second hook bearing portion 178 extending angularly upward and away from the rod 112. As illustrated in FIG. 6*c*, the second hook first portion 177 extends further down than the first hook first portion 173 by a distance 181. The first portion 173, the bearing portion 174, and the second portion 175 each of the first hook 172 can form a shank portion 183 of the first hook 172. The first hook shank portion 183 can have a uniform thickness and a lateral length. The first portion 177, the bearing portion 178, and the second portion 179 each of the second hook 176 also can form a shank portion 186 of the second hook 176. The second hook shank portion 186 can have a uniform thickness and lateral length, though the second hook 176 can be the same or different from that of the first hook 172. The hooks 170 are preferably formed of processes and materials similar to that of the rod 12, 112 and the tube 20, 120 in order to evoke a uniform decorative look among the components.

Referring generally to all of the Figures, a method of assembly or installation can be provided for the valet rod slide mounting assembly 10, 110. One step can include mounting the anchors 40 to the supporting surface 8. The anchors 40 can be mounted by using the mounting elements 50 provided. The mounting step can be performed by positioning the mounting surface 42 of each anchor 40 against the supporting surface 8, aligning each anchor 40 to define a line or plane parallel to the ground, marking the desired locations of each anchor 40 through each second bore 48, drilling a suitable sized hole at each marked location into the supporting surface 8, positioning each anchor 40 at the drilled location by centering the second bore 48 with the drilled hole, inserting the mounting element 50 through the second bore 48 of one anchor 40 and through the drilled hole, and fastening the mounting element 50 to the supporting surface 8 to mount the anchor 40 to the supporting surface 8.

Another step can include inserting, sliding, and guiding the tube 20 through the first bore 46 of each of the anchors 40. Preferably, the tube 20 is inserted after the anchors 40 are mounted, and the tube 20 is positioned parallel to the ground. The tube 20 can include the rod 12 already within the tube 20, or alternatively, can include the bushing member 30, the rod 12, or both already in the tube 20. If either is not included, then another step can be inserting, sliding, and guiding the rod 12, the bushing member 30, or both within the tube 20. In this case, the rod 12 is inserted into lumen 33 of the bushing member 30, the means 19 for retaining is attached to the end of the rod 12, and the bushing member 30, including the rod 12, is forcibly inserted into the lumen 23 of the tube 20. Yet, another step can include coupling the tube retainer 60 to at least one anchor 40. The coupling step can be performed by inserting the tube retainer 60 through the third bore 62 and engaging the tube retainer 60 securably against the tube 20 in order for the tube 20 not to slide easily. Another step can include attaching the handle 54 to one end of the rod 12.

When the plurality of hooks 170 are provided, then another step can include aligning the rod slot 118 with the tube slot 119 and the anchor channel 164. Then, another step can include attaching independently the hooks 170 to the rod slot 118 through the tube slot 119 and the anchor channel 164, and orienting the hooks 170 away from the supporting surface. Alternatively, the plurality of hooks 170 can be attached to the support member 180 to define the unitary hook attachment 182, and the unitary hook attachment 182 can then be attached to the rod slot 118, such that the hooks are oriented away from the supporting surface. Optionally, a unitary hook attachment can be provided, and the unitary hook attachment 182 can be attached to the rod slot 118.

From the forgoing description of the structure and operation of a preferred embodiment of the present invention, it will be apparent to those skilled in the art that the present invention is susceptible to numerous modifications and embodiments within the ability of those skilled in the art and without exercise of the inventive facility. Accordingly, the scope of the present invention is defined as set forth of the following claims.

What is claimed is:

1. A rod slide mounting assembly for mounting to a supporting surface, the assembly comprising:

a rod;

a tube receiving the rod for sliding movement relative to the tube; and at least two anchors for mounting the tube, each anchor including a first bore sized to receive the tube, a second bore perpendicular to the first bore and sized to receive a mounting element to mount the anchor, and a channel;

wherein the tube includes a slot aligned with the channel, and the channel is defined by the first bore in each anchor being positioned to intersect with a lower surface of each anchor.

2. The rod slide mounting assembly of claim 1 further comprising a plurality of hooks depending from the rod through the tube slot.

3. The rod slide mounting assembly of claim 2, wherein the rod includes a slot and the plurality of hooks are attached to a supporting member to define a unitary hook attachment, the unitary hook attachment being attached within the rod slot.

4. The rod slide mounting assembly of claim 2, wherein at least one first hook of the plurality of hooks comprises a first portion attached to the rod extending angularly downward and away from the rod, a bearing portion attached to the first portion extending horizontally and perpendicular to said supporting surface when attached, and a second portion attached to the bearing portion extending angularly upward and away from the rod.

5. The rod slide mounting assembly of claim 4, wherein at least one second hook of the plurality of hooks comprises a first portion attached to the rod extending angularly downward and away from the rod, a bearing portion attached to the second hook first portion extending horizontally and perpendicular to said supporting surface when attached, and a second portion attached to the second hook bearing portion extending angularly upward and away from the rod, wherein the first portion of the second hook extends further down than the first portion of the first hook.

6. A rod slide mounting assembly for mounting to a supporting surface, the assembly comprising:

a rod;

a tube receiving the rod for sliding movement relative to the tube;

at least two anchors for mounting the tube, each anchor including a first bore sized to receive the tube, and a second bore perpendicular to the first bore and sized to receive a mounting element to mount the anchor; and a bushing member securably engaged within a lumen of the tube, wherein the bushing member receives the rod for sliding movement relative to the bushing member.

7. The rod slide mounting assembly of claim 6, wherein the rod includes a means for retaining the rod to prevent the rod from sliding completely out of the bushing member.

8. The rod slide mounting assembly of claim 7, wherein the means for retaining comprises a washer defining an opening and a threaded fastener attached to the one end of the rod through the opening of the washer.

9. A rod slide mounting assembly for mounting to a supporting surface, the assembly comprising:

a rod;

a tube defining a lumen and including a slot, the tube receiving the rod for sliding movement relative to the tube;

a bushing member including a slot, the bushing member securably engaged with the tube lumen;

at least two anchors each including a first bore sized to receive the tube, a second bore perpendicular to the first bore and sized to receive a mounting element, and a channel aligned with the tube slot and the bushing member slot, the channel defined by the first bore in each anchor being positioned to intersect with a lower surface of each anchor; and a plurality of hooks depending from the rod through the tube slot.

10. The rod slide mounting assembly of claim 9, wherein each anchor comprises a cylindrical body having a mounting surface and an obverse surface each parallel to said supporting surface when mounted, the second bore being substantially centered throughout the cylindrical body from the obverse surface to the mounting surface.

11. The rod slide mounting assembly of claim 10 further comprising a tube retainer for coupling the tube at a selected position within the first bore, and each anchor comprises a third bore perpendicular to the second bore and sized to receive the tube retainer.

12. The rod slide mounting assembly of claim 9, wherein the rod includes a means for retaining the rod to prevent the rod from sliding completely out of the bushing member.

13. The rod slide mounting assembly of claim 9, wherein at least one first hook of the plurality of hooks comprises a first portion attached to the rod extending angularly downward and away from the rod, a bearing portion attached to the first portion extending horizontally and perpendicular to said supporting surface when attached, and a second portion attached to the bearing portion extending angularly upward and away from the rod.

14. The rod slide mounting assembly of claim 13 wherein at least one second hook of the plurality of hooks comprises a first portion attached to the rod extending angularly downward and away from the rod, a bearing portion attached to the second hook first portion extending horizontally and perpendicular to said supporting surface when attached, and a second portion attached to the second hook bearing portion extending angularly upward and away from the rod, wherein the first portion of the second hook extends further down than the first portion of the first hook.

15. A rod slide mounting assembly, the assembly comprising:

a rod having a first end and a second end opposite the first end;

a tube defining a lumen and including a slot, the tube receiving the rod for sliding movement relative to the tube;

a bushing member including a slot, the bushing member securably engaged with the tube lumen, wherein the rod includes a means for retaining attached to the second end of the rod to prevent the rod from sliding completely out of the bushing member;

at least two anchors for retaining the tube, each anchor including a first bore sized to receive the tube, a second bore perpendicular to the first bore and sized to receive a mounting element for mounting each anchor to a supporting surface, and a third bore perpendicular to the second bore and sized to receive a tube retainer for coupling the tube at a selected position within the first bore; and a handle removably attached to the first end of the rod.

* * * * *